United States Patent [19]

Köhler

[11] 4,448,829

[45] May 15, 1984

[54] METAL-PLASTIC LAMINATE TUBE CONSTRUCTION WITH PLASTIC TUBE HEAD

[75] Inventor: Andreas Köhler, Nürtingen, Fed. Rep. of Germany

[73] Assignee: Automation Industrielle SA, Switzerland

[21] Appl. No.: 499,175

[22] Filed: Jun. 3, 1983

Related U.S. Application Data

[63] Continuation of Ser. No. 300,791, Sep. 10, 1981, abandoned.

[30] Foreign Application Priority Data

Jul. 11, 1980 [DE] Fed. Rep. of Germany ..... 3042073

[51] Int. Cl.[3] ..... B65D 35/10; B29C 27/02

[52] U.S. Cl. ..... 222/107; 156/69; 156/218; 156/304.2; 428/36

[58] Field of Search ..... 222/92, 107; 156/69, 156/218, 304.2; 428/36

[56] References Cited

U.S. PATENT DOCUMENTS

| | | | |
|---|---|---|---|
| 3,260,410 | 7/1966 | Brandt et al. | 156/69 |
| 3,700,513 | 10/1972 | Haberhauer et al. | 156/69 |
| 3,962,006 | 6/1976 | Saito et al. | 156/69 |
| 4,132,331 | 1/1979 | Mägerle | 222/107 |

*Primary Examiner*—William R. Dixon, Jr.
*Attorney, Agent, or Firm*—Paul J. Cook

[57] ABSTRACT

A flexible tube construction is provided including a tube body and washer, each comprising a laminate having a metal barrier layer and a plastic layer which are adhered to each other by a butt connection. A plastic tube head is adhered to a synthetic plastic tube head having an opening through which the contents of the tube can be removed.

4 Claims, 2 Drawing Figures

METAL-PLASTIC LAMINATE TUBE CONSTRUCTION WITH PLASTIC TUBE HEAD

This application is a continuation of Ser. No. 300,791, filed Sept. 10, 1981, now abandoned.

BACKGROUND OF THE INVENTION

The invention relates to a tube consisting of a tube body of a laminate including a metallic barrier layer, a tube head of a synthetic plastics material and a washer of a laminate with metallic barrier layer arranged on the outer surface of the tube head shoulder.

As shown in FIGS. 4 and 5 of U.S. Pat. No. 4,132,331, the margin of the tube body overlaps the washer arranged on the stepped tube head. The washer likewise has a step which is adapted to the form of the tube head shoulder. In this case, the washer functions as a connecting body and has a substantially thicker metal layer than the tube body. This achieves the object that in the proposed inductive welding, the required frequency is adapted to this thicker metal layer so that the metal layer in the tube practically does not heat. The metallic barrier layer in the washer also serves to increase the gas-tightness in the tube head.

Since the washer and the tube overlap between their two metal layers serving as barrier, there lie two synthetic plastics layers which do not possess gas-tightness, so that thus a certain gas permeability is effected.

However, in tubes the important point is that they have an attractive appearance. In order to obtain tube shoulders which are reasonably attractive, the tube head and thus also the washer must be stepped so that the tube can be formed to the head without unsightly doming, such as necessarily develops when one layer is overlapped by another. From this, however, it also follows that the stepped washer must have a thicker metal layer than the tube body, since only then can the draw-moulding operation necessary for production be carried out. This, however, signifies that a substantially dearer laminate must be used, which in itself alone already increases the production costs of tube. Moreover, differences of color toning between tube body and washer material are unavoidable, and since they necessarily lie side by side in the overlap region on the tube shoulder, this is detrimental to the attractive appearance, since two color rings are distinguished on the tube shoulder, possibly yet a third in the region of attenuation of the material of the tube body which must seal the free end of the metal layer.

U.S. Pat. No. 3,260,411 discloses a similar tube where the washer is arranged on the inner surface of the tube head, here rounded, in such a way that the washer engages beneath the marginal region of the tube body on the outer edge of the head, while the outer edge of the washer can be bent back upwards into the head. In this case, a space always remains between the metal layer of the tube body and that of the washer, which space is filled only by synthetic plastics material so that the gas-tightness is impaired in the tube head region.

U.S. Pat. No. 3,700,513 discloses a tube in which the upper margin of the tube body is inserted on the outer surface of the shoulder of the tube head, which necessitates complicated machines and lengthens production; then a tapered shoulder ring is applied and finally everything is welded by pressure and heating, such as by induction.

It is common to all these tubes that very much and more expensive material, which moreover differs from the material of the tube body, is necessary for the washer, on account of its size and configuration, and also on account of the occurrence of waste. In the tube according to the U.S. Pat. No. 3,700,513, moreover, material of the tube bodies is required for insertion in folds on the tube head.

It is an object of this invention to provide a tube of the initially stated kind by which it is possible to save material and to improve the gas-tightness and the appearance in the head region.

SUMMARY OF THE INVENTION

A tube is provided comprising a tube body of a laminate having a metallic barrier layer, a synthetic plastic tube head and a washer of a laminate having a metallic barrier layer arranged on the outer surface of the tube head shoulder. The washer rests with its outer marginal edge directly on the cut edge of the tubular body and the butt connection thus formed is sealed.

Due to the butt joining of washer and tube body, the washer is smaller in diameter, so that material is saved. The washer does not require a step so that a thicker metal layer is not necessary. Due to the butt connection, the barrier metal layers of washer and tube body lie so close to one another, even if they are not made of equal thicknesses, that nearly optimum gas-tightness is guaranteed. Moreover, no material attenuations are necessary for the sealing of exposed metal layer ends. Between the tube body and the washer there is an attractive uniform transition lying in one plane. Preferably, when the same laminate material is used for washer and tube body, additional costs are eliminated and an absolute color match is guaranteed.

DESCRIPTION OF SPECIFIC EMBODIMENTS

Figure 1:
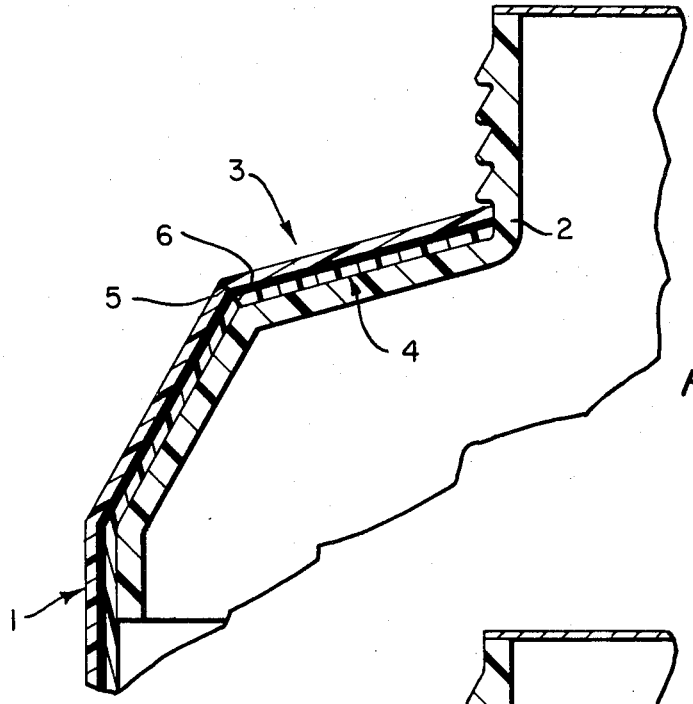
Figure 2:
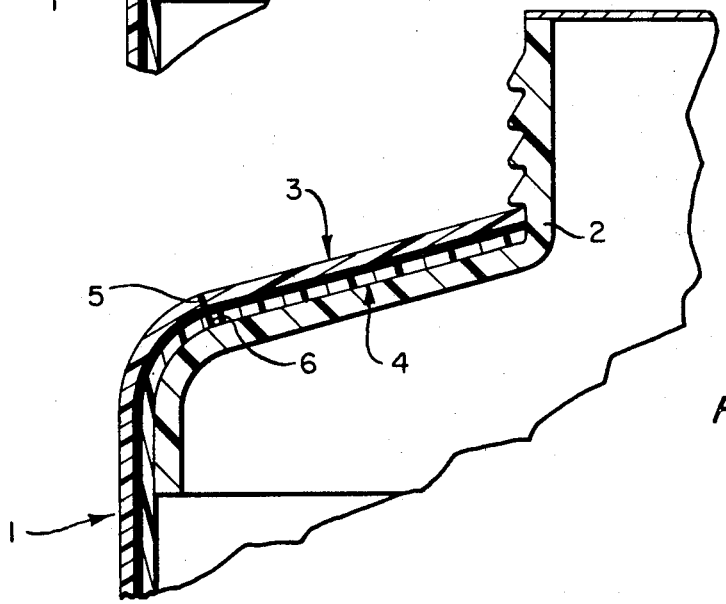

The invention will be explained in greater detail below by means of examples of embodiment with reference to drawings, wherein:

FIG. 1 shows the head region of a tube according to the invention with stepped shoulder of the tube head in section, FIG. 2 shows the head region of a tube according to the invention with rounded shoulder of the tube head, in section.

A tube comprises a tube body 1, a tube head 2 and a conical annular washer 3. The tube body 1 and the washer 3 are produced from a laminate with enclosed metal layer. Both preferably consist of the same material. The tube head 2 consists of a synthetic plastics material and has in the marginal region of its shoulder 4 a stepped form (FIG. 1) or a rounded form (FIG. 2). The washer 3 is laid upon the shoulder 4 and the tube body 1 is pushed on to the tube head 2 so that in moulding together its cut edge 5 abuts on the outer marginal edge 6. It is also possible for the tube body first to be positioned and then the washer 3 inserted. The tube body 1 or the washer 3 can already be connected with the tube head 2 before the other part in each case is positioned.

The butt joint formed between the cut edge 5 and the marginal edge 6 is preferably sealed by heat transmission, possibly with application of pressure. This can take place separately or in connection with the connecting of the tube body 1 and the washer 3 with the tube head 2. The connecting of the tube body 1 and the washer 3 with the tube head 2 and the sealing of the butt joint can be effected by induction, ultrasonics, radiation heat (for example infrared) or by combination of these possibilities.

The possibility also exists of firstly butt-joining the tube body 1 with the washer 3 and then providing them with an injection-moulded tube head 2, or equally of directly moulding or injection-moulding this tube head 2 into position, the sealing of the butt joint taking place at the same time.

I claim:

1. A tube comprising a tube body formed from a laminate having a metallic barrier layer and at least one plastic layer, a synthetic plastic tube head and a washer formed from a laminate having a metallic barrier layer and at least one plastic layer, said washer being positioned on the outer surface of the tube head shoulder, characterized in that the washer rests with its outer marginal edge directly on a cut edge of the tubular body and the butt connection thus formed is sealed.

2. The tube according to claim 1, characterized in that the washer and the tube body consist of the same laminate material.

3. The tube according to claim 1 or 2, characterized in that the washer and the tube body are arranged on a tube head and fused all together in one operation.

4. The tube according to claim 1 or 2, characterized in that the tube head is moulded or injection-moulded in, after production of the butt connection between tube body and washer, and the sealing of the butt connection is effected at the same time.

* * * * *